United States Patent [19]

Tanaka et al.

[11] Patent Number: 4,504,563

[45] Date of Patent: Mar. 12, 1985

[54] TONER FOR DEVELOPING ELECTROSTATIC LATENT IMAGE CONTAINING COPOLYMER OF VINYL COMPOUND AND ACID MONOMER

[75] Inventors: Koichi Tanaka; Hiroshi Takayama; Yoshimi Amagai; Shigeo Aonuma; Yasuji Fukase, all of Kanagawa, Japan

[73] Assignee: Fuji Xerox Co., Ltd., Tokyo, Japan

[21] Appl. No.: 138,949

[22] Filed: Apr. 9, 1980

[30] Foreign Application Priority Data

Apr. 9, 1979 [JP] Japan ..... 54-42117

[51] Int. Cl.[3] ..... G03G 9/08

[52] U.S. Cl. ..... 430/109; 430/904; 430/107

[58] Field of Search ..... 430/110, 107, 109, 904

[56] References Cited

U.S. PATENT DOCUMENTS

| | | | |
|---|---|---|---|
| Re. 27,912 | 2/1974 | Miller | 430/904 |
| 2,297,691 | 10/1942 | Carlson | 430/120 X |
| 3,013,890 | 12/1961 | Bixby | 430/111 X |
| 3,236,776 | 2/1966 | Tomanek | 430/111 X |
| 3,239,465 | 3/1966 | Rhemfrank | 430/122 X |
| 3,933,665 | 1/1976 | Van Engeland et al. | 430/110 X |
| 3,944,682 | 3/1976 | Miyatsuka et al. | 430/84 |
| 4,137,188 | 1/1979 | Uetake et al. | 430/111 |
| 4,259,426 | 3/1981 | Hasegawa et al. | 430/138 X |

*Primary Examiner*—John D. Welsh

*Attorney, Agent, or Firm*—Sughrue, Mion, Zinn, Macpeak, and Seas

[57] ABSTRACT

A toner for developing an electrostatic latent image characterized by a vinyl copolymer whose acid value is in the range of about 5 to 100.

15 Claims, No Drawings

TONER FOR DEVELOPING ELECTROSTATIC LATENT IMAGE CONTAINING COPOLYMER OF VINYL COMPOUND AND ACID MONOMER

BACKGROUND OF THE INVENTION

1. Field of the Invention

This invention relates to a toner used to develop an electrostatic latent image such as by electrophotography, electrostatic recording, electrostatic printing or similar techniques.

2. Description of the Prior Art

In the reproduction of copies from originals, generally an electrostatic image is first formed on a photosensitive medium or a dielectric film which is then developed by deposition with fine powder called a toner which is made of a colorant dispersed in a binder resin. After transferring the toner image to the surface of a support such as paper, the transferred image is perpetually fixed on the support surface such as by application of heat, to give a copy. A solvent treatment or a finish coating treatment has been used to fix a toner image, however, it is a more common practice to use a heat fixing method in which a toner image is heated up to a temperature at which the toner is capable of flowing so as to permit the toner to be fusingly attached to the support, thereby giving a final copy of the toner image.

In an attempt to speed up the duplication, a so-called heat roll fixing method has come into practice in which a toner image-bearing support is passed between a pair of rolls, i.e., a heat roll and a press roll, to fix it under heating and pressing conditions. The heat roll fixing method is higher in heat efficiency, lower in heat emission and quicker for fixation than other heat fixing methods, and is thus very effective. In this method, however, the toner image is brought to contact with the rolls, so that part of the toner image is apt to attach to the heat roll, causing the so-called offset phenomenon.

In order to inhibit the offset phenomenon, the surfaces of the rolls are usually covered with a material with an excellent releasing property such as a fluorine-contained resin and treated with an offset-inhibiting liquid such as a silicon oil. The application of the offset-inhibiting liquid in turn requires a device for consistently feeding a given amount of the offset-inhibiting liquid to the roll surface, coupled with the disadvantages that leakage of oil takes place and that silicon oil emanates an offensive odor on heating.

In recent years, attempts have accordingly been made to make the heat roll fixation feasible without use of any offset-inhibiting liquid. For instance, a method is described in Japanese Patent Publication No. 5549/78 (U.S. Pat. No. 3,666,247). Attempts to realize this feasibility by improvement of the toner are described in Japanese patent application (OPI) No. 65231/74 (British Pat. No. 1,442,835).

In Japanese Application (OPI) No. 65231/74, a mixture of a styrene resin and a low molecular weight polypropylene is used as a binder resin for the toner. On heating for fixation, the low molecular weight polypropylene turns into a liquid of low viscosity and is released on the toner surface where it covers the toner, and inhibits the offset phenomenon due to the releasing property of the polypropylene itself. According to this disclosure, it appears that offset-free, heat roll fixing is possible without the use of any offset-inhibiting liquid. However, this technique has a number of disadvantages. Poor compatibility of the styrene resin with the polypropylene results in the composition of toner particles becoming non-uniform (i.e., non-homogeneous). Furthermore, differences in the triboelectric charging properties of the toner particles leads to a reduction in developability, and results in a short lifetime or in a tendency for the toners to aggregate.

Accordingly, there is a need for a toner which is readily fixed and can prevent offset without the use of an offset-inhibiting liquid, and which exhibits good developability and cleanability and provides a homogeneous toner composition having good workability.

SUMMARY OF THE INVENTION

Accordingly one object of the present invention is the provision of a toner which can be readily fixed and prevents the offset phenomenon without using any offset-inhibiting liquid and which is applicable to heat roll fixation.

Another object of the present invention is to provide a toner which has good developability and is particularly stable in its triboelectric charging property.

A further object of this invention is to provide a toner which does not form a toner film on, for example, a photosensitive medium and shows good cleanability.

A still further object of this invention is to provide a toner which is improved in kneadability and milling ability at the time of toner production and also in the deposition of toner on rotor or the like means.

Another object of the present invention is to provide a toner which is free of a contaminating carrier and shows no tendency to aggregate.

The above objects of the invention are achieved using, as a binder resin for the toner, a vinyl copolymer whose acid value is in the range of from about 5 to 100, and preferably from 10 to 40.

DETAILED DESCRIPTION OF THE INVENTION

The vinyl copolymer whose acid value is in the range of 5 to 100 is a copolymer obtained by copolymerizing a vinyl monomer and an acid monomer copolymerizable with the vinyl monomer. The copolymer can be obtained by copolymerizing one or more vinyl monomers with a copolymerizable acid.

The vinyl monomers useful in the present invention are those having a polymerizable vinyl bond of the formula $CH_2{=}CH{-}$ in the structural formula. Examples of such vinyl monomer include styrenes such as styrene, chlorostyrene, α-methylene and the like; monocarboxylic acid esters such as methyl methacrylate, ethyl methacrylate, n-butyl methacrylate, methyl acrylate, ethyl acrylate, n-butyl acrylate, dodecyl acrylate, 2-chloroethyl acrylate and the like; vinyl halides such as vinyl chloride, vinyl bromide, vinyl fluoride and the like; vinyl esters such as vinyl acetate, vinyl propionate, vinyl benzoate, vinyl butyrate and the like; acrylic or methacrylic derivatives such as acrylonitrile, methacrylonitrile, acrylamide and the like; vinyl ethers such as vinyl methyl ether, vinyl ethyl ether, vinyl isobutyl ether and the like; vinyl naphthalenes; vinylketones such as methyl vinyl ketone, hexyl vinyl ketone, methyl isopropenyl ketone and the like; and N-vinyl compounds such as N-vinylpyrrole, N-vinylcarbazole, N-vinylindole, N-vinylpyrrolidone and the like. These compounds may be used alone or in combination of two or more as the vinyl monomers.

The copolymerizable acids have a polymerizable bond such as a double bond and include, for example, acrylic acid, methacrylic acid, α-chloroacrylic acid, α-bromoacrylic acid, α-acylamidoacrylic acid, α-benzamidoacrylic acid, α-phenylacetamidoacrylic acid, α-ethylacrylic acid, crotonic acid and the like.

The acid value is the amount (mg) of potassium hydroxide required to neutralize the acid contained in 1 g of resin.

One or more of the vinyl monomers may be copolymerized with the polymerizable acid monomer by solution polymerization, bulk polymerization or suspension polymerization. On copolymerization the mixing ratio should be suitably adjusted so that the resulting copolymer has an acid value of 5 to 100. Though the mixing ratio varies depending on the type and number of monomer used, it is important that the mixing ratio is so determined that the prepared copolymer has an acid value of 5 to 100.

For instance, when styrene is used as the vinyl monomer and acrylic acid as the polymerizable acid, the amount of the acrylic acid is in the range of about 1 to 17 mole % of the total amount of the monomers.

The copolymer preferably has a glass transition temperature of 40° to 70° C. Glass transition temperatures lower than 40° C. tend to cause the toner particles to aggregate during storage. On the other hand, glass transition temperatures higher than 70° C. require higher fixing temperatures making it difficult to readily fix the toner.

As for the molecular weight, it is desired that the weight, it is desired that the weight average molecular weight $\overline{M}w$ of the polymer is in the range of about 50,000 to 500,000, preferably about 80,000 to 300,000, the number average molecular weight ($\overline{M}n$) is in the range of about 5,000 to 20,000, preferably about 10,000 to 20,000, and the ratio $\overline{M}w/\overline{M}n$ of the weight average molecular weight to the number average molecular weight is in the range of about 4 to 30, preferably about 8 to 30. In accordance with the present invention the $\overline{M}w/\overline{M}n$ range may be wider than in the case of no acid. In other words, in order to obtain a toner which shows good heat roll adaptability, the molecular weight distribution should be as wide as possible. A wide $\overline{M}w/\overline{M}n$ range is desirable in a toner in order to provide a broad fusing latitude, which results from the low molecular weight region contributing to the low-temperature fixing property, and the high molecular weight region contributing to offset-inhibiting property. In order to broaden the $\overline{M}w/\overline{M}n$ range, the weight average molecular weight, $\overline{M}w$, is generally increased to high value. To this end, a specific means or method is frequently required for the polymerization requiring that the heating conditions be continuously or intermittently varied.

When the copolymer contains an acid as in the present invention, by suitable selection of the amount of the acid it is not necessarily required that the molecular weight distribution is widened or the weight average molecular weight is increased, which results in higher effects as compared to the conventional methods. As desired, there may be used a copolymer of wider molecular weight distribution or larger weight average molecular weight.

One of the prominent features of the present invention resides in the use of a vinyl polymer as a binder resin for the toner. The use of the vinyl polymer is advantageous in offset-inhibiting ability in comparison to condensate resins such as polyester or an epoxy resin.

Another feature of the present invention resides in that the acid value is in the range of about 5 to 100, i.e., in the specific content of acid in the binder resin. Preferably, the acid value is from 10 to 40. The acid value so specified produces a more pronounced offset-inhibiting effect without increasing the molecular weight of the vinyl copolymer. The introduction of the acid into the copolymer imparts good negative charging property to the copolymer.

A further feature of this invention resides in the use of a copolymer as the binder resin. That is, toner for heat roll fixing described in Japanese Application (OPI) No. 65231/74 which serves to prevent occurrence of the offset phenomenon without use of any offset-inhibiting liquid makes use of a mixture of resins, as opposed to a copolymer, and presents a problem of compatability. Further, when the mixture is milled to provide toner particles, the individual toner particles obtained are inhomogeneous (i.e., aggregate into various sized clusters) which deterimentally affects triboelectric charging property, i.e., the triboelectric charging property of the resulting toner particles differ from each other, and the fixing property therefore varies. On the other hand, the claimed invention is free from such problem. In this connection, however, since, according to the present invention, the copolymer is used as the binder resin and the toner particles of a size on the order of a micron which are much greater than molecules in the order of an angstrom have a uniform composition leading to stable production and development.

The copolymer according to the invention may be used alone as a binder resin of the toner. Alternatively, it may be used with other resins. In the latter case, care must be paid to a combination of resins and a mixing ratio to avoid the problem of poor compatability inhomogenity previously described. When using in combination with other resin, the vinyl copolymer according to the invention should make up a major proportion of the binder resin and preferably makes up more than about 80% by weight of the total binder resin.

The vinyl copolymer resin having an acid value of 5 to 100 is mixed with a colorant and then finely powder to give a toner.

Any suitable dye or pigment may be used as the colorant in an amount sufficient to color the binder resin therewith. The amount is generally in a range up to about 25 wt %, preferably about 1 to 20% by weight, of the toner.

Useful colorant include, for example, carbon black, Nigrosine dyes, Aniline Blue, Alkoyl Blue, Chrome Yellow, Ultramarine Blue, Du Pont Oil Red, Quinoline Yellow, Methylene Blue, Phthalocyanine Blue, Malachite Green, Lamp Black, Rose Bengale and the like. The vinyl copolymer having an acid value of 5 to 100 is admixed with a colorant such as a dye or pigment and finely milled to give a toner for developing electrostatic latent image. Any known method can be used to uniformly disperse the colorant in the binder resin to obtain toner particles. For example, the binder resin and colorant may be melted and kneaded, then hardened by cooling, and finely milled such as by a jet milling machine to give particles of a size usually employed as a toner. Typically, the particles have an average size below about 30μ, preferably about 10 to 20μ. The binder resin and colorant dissolved in solvent may be spray-dried to give a fine powder of a toner. The toner is then mixed with a carrier to form a developer. The toner may be admixed with a magnetic powder to give a developer without the use of any carrier.

The developer is brought into contact with an electrostatic latent image-bearing photosensitive medium or dielectric film by a cascade developing method or a magnetic brush developing method to yield a visual toner image. The thus obtained toner image is transferred to a support such as paper. The toner image-bearing support is passed between a pair of heat rollers, i.e., a heat roll and a press roll. The roll which contacts with the toner image is covered on its surface with a fluorine-contained resin such as Teflon (a product of E. I. Du Pont de Nemours & Co., Ltd.) or a silicon rubber, or has a metal surface, to which no offset-inhibiting liquid is fed. After passage of the support between the rolls, the toner image is everlasting fixed on the support. When the toner according to this invention is used, no deposition of the toner on the roll or the support takes place even though no offset inhibiting liquid is used.

A magnetic powder can also be incorporated with the binder and colorant. This is done when it is desired to carry out the development without using a carrier. Examples of magnetic powders which can be used are powders of metals, e.g., iron, manganese, nickel, cobalt, chromium, etc.; alloys, e.g., ferrite, magnetite, etc.; and other strongly magnetic materials. A suitable amount of the magnetic powder is about 10 to 70% by weight of the weight of the toner.

When the vinyl copolymer having an acid value of 5 to 100 is used as the toner binder resin, the toner shows a pronounced characteristic effect of development of electrostatic latent image. This is more pronounced when the toner is applied to a heat roll fixing method using no offset-inhibiting liquid. Needless to say, use of the vinyl copolymer is favorable in view of excellent developability, cleanability and producibility of the toner.

The reason the vinyl copolymer having an acid value of 5 to 100 shows such favorable characteristics when applied as a toner is considered as follows. Since an acid is contained in a specified amount, an intermolecular coagulating force by the action of, for example, hydrogen bonds is produced. This is supported, as shown in Example 1 appearing herein, by a fact that three types of polymers which have the same component ratios but are different in the amount of acid alone and for which the differences in the theoretical glass temperature $T_g$ is about 2° to 3° C. exhibit a drastically increased measured glass transition temperature $T_g$ with an increase of amount of the acid.

Taking into account the fact that the glass transition temperature usually increases with an increase in the degree of crosslinking or the molecular weight, it is believed that the introduction of the acid into the polymer shows similar effects as in the case of increasing the molecular weight of the polymer but the actual molecular weight is not so that good fixability can not be achieved.

The present invention will be particularly illustrated by way of the following examples.

EXAMPLE 1

Resin Preparation

I-a (Vinyl Copolymer for Comparison)

300 ml of toluene was added to 1 l four neck distillation flask to which was further added 3 g of azobisisobutyronitrile. An initial reaction mixture composed of 120 g of styrene, 60 g of methyl methacrylate and 120 g of iso-butyl methacrylate was dripped from one port of the four neck distillation flask at a constant dropping rate, followed by polymerizing while agitating at the refluxing temperature (111° C.) of toluene. It took about 6 hours from commencement of the dripping till completion of the polymerization. After completion of the polymerization, the solvent was removed and vacuum dried to obtain a copolymer. The thus obtained copolymer had a glass transition temperature ($T_g$) of 40° C., a weight average molecular weight ($\overline{M}w$) of 83,000 and a number average molecular weight ($\overline{M}n$) of 10,000.

I-b (Vinyl Copolymer for Comparison)

This copolymer was prepared in the same manner as in the above procedure I-a except that the initial reaction mixture was dripped at the same rate as in procedure I-a up to 3 hours after commencement of the dripping and then at a rate twice as high as the first speed. It took 4.5 hours till the polymerization was completed. The resulting copolymer had $T_g$ of 40° C., $\overline{M}w$ of 300,000, and $\overline{M}n$ of 11,000.

I-c (Vinyl Copolymer according to Invention)

This copolymer was prepared in the same manner as in procedure I-a except that 7.5 g of methacrylic acid was added to the initial reaction mixture. The resulting copolymer had $T_g$ of 45° C., $\overline{M}w$ of 86,000, $\overline{M}n$ of 10,300 and an acid value of 16 (mgKOH/g).

I-d (Vinyl Copolymer according to Invention)

This copolymer was prepared in the same manner as in procedure I-a except that 15 g of methacrylic acid was added to the initial reaction mixture. The copolymer had $T_g$ of 46° C., $\overline{M}w$ of 83,000, $\overline{M}n$ of 10,700 and an acid value of 31 (mgKOH/g).

I-e (Vinyl Copolymer according to Invention)

This copolymer was prepared in the same manner as in procedure I-a except that 22.5 g of methacrylic acid was added to the initial reaction mixture. The copolymer had $T_g$ of 63° C., $\overline{M}w$ of 84,000, $\overline{M}n$ of 10,000 and an acid value of 45 (mgKOH/g).

I-f (Vinyl Copolymer according to Invention)

This copolymer was prepared in the same manner as in procedure I-b except that 15 g of methacrylic acid was added to the initial reaction mixture. The copolymer had $T_g$ of 46° C., $\overline{M}w$ of 310,000, $\overline{M}n$ of 11,000 and an acid value of 31 (mgKOH/g).

Toner Preparation 100 parts by weight of each of the resins I-a, I-b, I-c, I-d, I-e, and I-f and 11 parts by weight of carbon black were melted and kneaded in a Banbury mixer and, after rough powdering, finely powdered in a jet mill to obtain toners I-1, I-2, I-3, I-4, I-5 and I-6. These toner particles were found to have a size of 10 to 20$\mu$.

It will be noted that the toners I-1 and I-2 are for comparative purposes. When the Banbury mixer was opened at the lower part thereof after the kneading, the toners I-1 and I-2 did not readily drop out because of attachment to the rotor and had to be scraped off, thus being poor in workability. In contrast, the toners I-3 to I-6 released very smoothly from the rotor when the mixer was opened and dropped out without producing any residual deposition, thus being very excellent in workability.

2 parts by weight of each of the toners was mixed with 100 parts by weight of iron powder with a size of 100μ to give a developer. Each developer was used for duplication in a duplicator of the Xerox® Model 9200 which was incorporated with a heat roll fixing device including a pair of rolls, i.e., a heat roll and a press roll, each having a covering of Teflon (product of E. I. DuPont de Nemours & Co., Inc.) and using no offset-inhibiting liquid. The results are shown in Table 1.

It was found that as compared with the comparative samples I-1 and I-2, the toners I-3 to I-6 using the copolymers introduced with acids reached a final saturated charging level with a shorter mixing time with a carrier and the introduction of the acids contributed to imparting negative chargeability.

As for the heat roll fixability, the toner I-2 which was increased in its weight average molecular weight was found to produce no offset phenomenon even at 210° C. when visually observed and was thus superior in the heat roll fixability to the toner I-1. However, when white paper was forced against the heat roll while reproducing copies at 200° C., it was soiled considerably, revealing that a slight degree of the offset phenomenon as could not be observed visually took place. The feed of oil is considered essential if this toner is employed.

In contrast, the toners I-3 to I-6 were found to produce much reduced degree of deposition by the offset phenomenon when evaluated by forcing white paper against the heat roll, not to mention that there was no visual occurrence of offset phenomenon up to 210° C. More particularly, the toner I-3 using the polymer with an acid value of 16 was found to be much more reduced in soil of the white paper with the toner than the case using the toner I-2. The toners I-4 to I-6 using the polymers with acid values exceeding 30 showed no soiling of the white paper and were completely free from the offset phenomenon even though no oil was used.

TABLE 1

| Toner | Classification | Acid Value | Triboelectric Saturation Velocity[1] (sec) | Triboelectric Charging Quantity[2] (μc/g) | Minimum Fixing Temp. (°C.) | Offset Initiating Temp. (°C.) | State of Offset at 200° C. |
|---|---|---|---|---|---|---|---|
| I-1 | Comparative Example | — | 60 | 5 | 160 | 190 | Very considerable |
| I-2 | Comparative Example | — | 90 | 3 | 160 | >210 | Considerable |
| I-3 | Example | 16 | 15 | 15 | 160 | >210 | Very slight |
| I-4 | " | 31 | 30 | 15 | 162 | >210 | Nil |
| I-5 | " | 45 | 15 | 20 | 165 | >210 | Nil |
| I-6 | " | 31 | 15 | 15 | 170 | >210 | Nil |

(1) 2 g of a toner is added to 100 g of a carrier in a glass bottle and its charging quantity is measured by the Turbula mixing machine (product of Willey A. Barphoen Co., Ltd.) while changing a mixing time of from 15 seconds to 180 seconds at 15 seconds intervals (whereupon samples are freshly prepared whenever changing the mixing time). Then, a mixing time to charging quantity ratio is plotted on a section paper to read a mixing time at which the charging quantity reaches a saturation.

(2) Charging quantity 15 seconds after mixing with carrier when measured by the above procedure (1).

EXAMPLE 2

Resin Preparation

II-a (Vinyl Copolymer for Comparison)

This copolymer was prepared in the same manner as in procedure I-a except that 120 g of styrene and 180 g of n-butyl methacrylate were used as the initial reaction mixture. The copolymer had $T_g$ of 40° C., $\overline{M}w$ of 150,000 and $\overline{M}n$ of 10,000.

II-b (Vinyl Copolymer according to Invention)

This copolymer was prepared in the same manner as in procedure II-a except that 7.5 g of acrylic acid was added to the initial reaction mixture. The copolymer had $T_g$ of 41° C., $\overline{M}w$ of 90,000, $\overline{M}n$ of 10,000 and an acid value of 19 (mgKOH/g).

II-c (Vinyl Copolymer according to Invention)

This copolymer was prepared in the same manner as in procedure II-a except that 15 g of acrylic acid was added to the initial reaction mixture. The copolymer had $T_g$ of 45° C., $\overline{M}w$ of 90,000, $\overline{M}n$ of 10,000 and an acid value of 37 (mgKOH/g).

Toner Preparation

Example 1 was repeated using the resins II-a, II-b and II-c to obtain toners II-1, II-2 and II-3.

The toner II-1 is a toner for comparative purpose. Similarly to Example 1, the toners of the present invention were found to show good producibility. After preparation of developers in the same manner as in Example 1, the duplication test was conducted. The results are shown in Table 2.

TABLE 2

| Toner | Classification | Acid Value | Triboelectric Saturation Velocity[1] (sec) | Triboelectric Charging Quantity[2] (μc/g) | Minimum Fixing Temp. (°C.) | Offset Initiating Temp. (°C.) | State of Offset at 200° C. |
|---|---|---|---|---|---|---|---|
| II-1 | Comparative Example | — | 90 | 10 | 155 | >210 | Very considerable |
| II-2 | Example | 19 | 30 | 25 | 159 | >210 | Very slight |
| II-3 | " | 37 | 30 | 30 | 160 | >210 | Nil |

[1] & [2]: the same as defined in Table 1

As will be clear from the results, similar to Example 1, the toners according to the present invention can suppress the offset phenomenon even when using no offset-inhibiting liquid and satisfy all the characteristics required for a toner.

While the invention has been described in detail and with reference to specific embodiments thereof, it will be apparent to one skilled in the art that various changes and modifications can be made therein without departing from the spirit and scope thereof.

What is claimed is:

1. In a toner comprising a binder and a colorant for developing an electrostatic latent image, the improvement which comprises said toner containing, as the binder, a vinyl copolymer comprising an ethylenically unsaturated monomer and a copolymerizable acid monomer, having an acid value of about 5 to 100.

2. The toner of claim 1, wherein the vinyl copolymer has an acid value of about 10 to 40.

3. The toner of claim 1, wherein said ethylenically unsaturated monomer is a styrene, a monocarboxylic acid ester, a vinyl halide, a vinyl ester, a vinyl ether, a vinyl naphthalene, a methacrylic or acrylic derivative, a vinyl ketone, or an N-vinyl compound.

4. The toner of claim 3, wherein said ethylenically unsaturated monomer is selected from the group consisting of styrene, chlorostyrene, α-methylstyrene, methyl methacrylate, ethyl methacrylate, n-butyl methacrylate, methyl acrylate, ethyl acrylate, n-butyl acrylate, dodecyl acrylate, 2-chloroethyl acrylate, vinyl chloride, vinyl bromide, vinyl fluoride, vinyl acetate, vinyl propionate, vinyl benzoate, vinyl butyrate, acrylonitrile, methacrylonitrile, acrylamide, vinyl methyl ether, vinyl ethyl ether, vinyl isobutyl ether, vinyl naphthalene, methyl vinyl ketone, hexyl vinyl ketone, methyl isopropenyl ketone, N-vinylpyrrole, N-vinylcarbazole, N-vinylindole, and N-vinylpyrrolidone.

5. The toner of claim 1, wherein said acid monomer is selected from the group consisting of acrylic acid, methacrylic acid, α-chloroacrylic acid, α-bromoacrylic acid, α-acylamidoacrylic acid, α-benzamidoacrylic acid, α-phenylacetoamidoacrylic acid, α-ethylacrylic acid, and crotonic acid.

6. The toner of claim 1 or 2, wherein said vinyl copolymer has a glass transition temperature of about 40° to 70° C.

7. The toner of claim 1 or 2, wherein said vinyl copolymer has a weight average molecular weight ($\overline{M}w$) of about 50,000 to 500,000, a number average molecular weight ($\overline{M}n$) of about 5,000 to 20,000 and a ratio of $\overline{M}w/\overline{M}n$ of about 4 to 30.

8. A toner of claim 7, wherein said vinyl copolymer has a weight average molecular weight ($\overline{M}w$) of about 80,000 to 300,000, a number average molecular weight ($\overline{M}n$) of about 10,000 to 20,000, and a ratio of $\overline{M}w/\overline{M}n$ of about 8 to 30.

9. The toner of claim 1 or 2, wherein said toner comprises carbon black.

10. The toner of claim 1 or 2, wherein said toner comprises a colorant selected from the group consisting of carbon black, Nigrosine dyes, Aniline Blue, Alkoyl Blue, Chrome Yellow, Ultramarine Blue, Du Pont Oil Red, Quinoline Yellow, Methylene Blue, Phthalocyanine Blue, Malachite Green, Lamp Black, Rose Bengale and the like.

11. The toner of claim 1 or 2, wherein said vinyl copolymer is a methyl methacrylate/iso-butyl methacrylate/methacrylic acid copolymer.

12. The toner of claim 1 or 2, wherein said vinyl copolymer is a styrene/n-butyl methacrylate/acrylic acid copolymer.

13. The toner of claim 1 or 2, wherein said toner comprises a magnetic powder.

14. The toner according to claim 13, wherein the magnetic powder comprises from about 10 to 70%, by weight, of the total weight of the toner.

15. The toner according to claim 1, wherein said vinyl copolymer makes up more than about 80% by weight of binder present.

* * * * *